US005913354A

United States Patent [19]

Conroy et al.

[11] Patent Number: 5,913,354

[45] Date of Patent: Jun. 22, 1999

[54] REMOVAL OF CERAMIC SHELL MOLD MATERIAL FROM CASTINGS

[75] Inventors: Patrick L. Conroy, Montague; Douglas W. Wilkinson, Whitehall, both of Mich.

[73] Assignee: Howmet Research Corporation, Whitehall, Mich.

[21] Appl. No.: 08/946,260

[22] Filed: Oct. 7, 1997

Related U.S. Application Data

[62] Division of application No. 08/445,759, May 22, 1995, Pat. No. 5,678,583.

[51] Int. Cl.[6] ..... B22D 29/00; B08B 9/20; B08B 7/00; B08B 3/00

[52] U.S. Cl. ..... 164/131; 134/25.4; 134/32; 134/33; 134/36

[58] Field of Search ..... 164/131; 134/25.4, 134/133, 153, 199, 32, 33, 36

[56] References Cited

U.S. PATENT DOCUMENTS

| | | | |
|---|---|---|---|
| 2,638,645 | 5/1953 | Olson . | |
| 2,664,472 | 7/1953 | Ward . | |
| 2,786,480 | 3/1957 | Hofer . | |
| 3,070,104 | 12/1962 | Faust et al. . | |
| 3,486,938 | 12/1969 | Dubitsky . | |
| 3,590,863 | 7/1971 | Faust et al. . | |
| 3,645,791 | 2/1972 | Sadwith . | |
| 3,716,094 | 2/1973 | Fuminier . | |
| 3,799,178 | 3/1974 | Anderson et al. . | |
| 4,134,777 | 1/1979 | Borom . | |
| 4,141,781 | 2/1979 | Greskovich et al. . | |
| 4,143,669 | 3/1979 | Minkin . | |
| 4,213,475 | 7/1980 | Minkin . | |
| 4,350,174 | 9/1982 | Bolten et al. . | |
| 4,569,384 | 2/1986 | Mills . | |
| 4,708,153 | 11/1987 | Hambleton et al. . | |
| 4,741,351 | 5/1988 | Minkin . | |
| 5,032,217 | 7/1991 | Tanaka | 134/25.4 |
| 5,129,956 | 7/1992 | Pickering et al. | 134/25.4 |
| 5,167,720 | 12/1992 | Diamond et al. | 134/25.4 |
| 5,507,306 | 4/1996 | Irvine et al. | 134/166 R |
| 5,526,835 | 6/1996 | Olechow | 134/153 |
| 5,529,080 | 6/1996 | Minkin | 134/153 |
| 5,540,246 | 7/1996 | Minkin et al. . | |
| 5,618,353 | 4/1997 | Irvine et al. . | |

FOREIGN PATENT DOCUMENTS

| | | |
|---|---|---|
| 0195510 | 9/1986 | European Pat. Off. . |
| 1 271 910 | 7/1968 | Germany . |
| 24 14 167 | 10/1975 | Germany . |
| 27 46 405 | 4/1979 | Germany . |
| 60-196260 | 4/1985 | Japan . |
| 007058 | 6/1986 | Japan . |
| 63-256239 | 10/1988 | Japan . |
| 872024 | 10/1981 | U.S.S.R. . |
| 997975 | 2/1983 | U.S.S.R. . |
| 1 549 220 | 7/1979 | United Kingdom . |
| 2 266 677 | 11/1993 | United Kingdom . |

OTHER PUBLICATIONS

Giesserei, vol. 73, No. 17, Aug., 1986, pp. 515–516, Duesseldorf, Germany.

Giesserei, vol. 75, No. 5, Feb., 1988, pp. 110–113, Duesseldorf, Germany.

ASM Handbook, vol. 5, Surface Engineering, 5 pages. Dec., 1994, Cotell et al.

Foundry Trade Journal 195(1991) Jul. 26, No. 3437 Redhill, Surrey, GB.

*Primary Examiner*—Patrick Ryan
*Assistant Examiner*—I.-H. Lin
*Attorney, Agent, or Firm*—Edward J. Timmer

[57] ABSTRACT

Method for removing ceramic shell mold material from one or more castings in a relatively rapid manner wherein the casting and hot caustic solution spray nozzles are relatively moved to direct hot caustic solution under pressure at the castings to remove post-knock-out ceramic shell material thereon prior to further processing of the castings.

12 Claims, 8 Drawing Sheets

REMOVAL OF CERAMIC SHELL MOLD MATERIAL FROM CASTINGS

This is a division of Ser. No. 08/445,759, filed May 22, 1995 and now issued as U.S. Pat. No. 5,678,583.

FIELD OF THE INVENTION

The present invention relates to method and apparatus for removing ceramic mold material from exterior surfaces of a casting.

BACKGROUND OF THE INVENTION

In the manufacture of gas turbine engine components, such as gas turbine engine blades and vanes, an appropriate alloy, such as a nickel or cobalt based superalloy, is investment cast in a ceramic investment mold having one or more mold cavities with a shape corresponding to the shape of the component to be cast. The shell mold may have one or more ceramic cores in the mold cavities in the event the cast component is to include one or more internal passages.

The investment shell mold is formed by the well known lost wax process wherein a wax (or other removable fugative material) pattern assembly is repeatedly dipped in ceramic slurry, drained of excess slurry, and then stuccoed with ceramic stucco to build up the shell mold to the desired mold wall thickness on the pattern assembly. The wax pattern then is removed from the green shell mold by various well known means, such as by heating to melt the pattern. The green shell mold then is fired at elevated temperature to develop adequate mold strength for casting. The fired investment shell mold can be used to cast one or more blades, vanes, or other components by well known techniques to have an equiaxed, columnar, or single crystal microstructure.

In the past, the ceramic investment shell mold has been removed from the investment cast component(s) by a knock-out operation where the casting in the mold is struck to dislodge loose mold material therefrom and then the casting with remnant mold material thereon is soaked in hot caustic to soften the mold material. For example, when the mold material comprises alumina based ceramic, the casting is soaked in 45% KOH caustic aqueous solution in an open vessel at 285 degrees F. (solution boiling temperature) for 13 hours to soften the mold material. The casting then is subjected to a water blast at 800 psi for 1.5 hours per load of castings to remove the softened mold material. Alternately, the casting can be sand blasted at 100 psi for up to 3 hours per casting to remove the softened ceramic mold material. This investment shell mold removal technique is quite slow and time-consuming, increasing the cost of the casting.

SUMMARY OF THE INVENTION

The present invention provides method and apparatus for removing ceramic mold material from exterior surfaces of one or more castings in a relatively rapid manner as compared to the aforementioned soaking and water or sand blasting technique described hereabove. An embodiment of the invention comprises relatively moving one or more castings having ceramic mold material thereon and a plurality of hot caustic sprays discharged under pressure at the castings from a plurality of different directions in order to clean exterior surface areas of the casting(s).

In one embodiment of the invention, one or more casting (s) having remnant ceramic mold material thereon are disposed on a rotatable table in the path of a plurality of fixed spray means, such as spray nozzles, from which the hot caustic solution is sprayed under pressure in different directions at the castings as they move past the spray means. The fixed spray means can be spaced apart at different peripheral (e.g. circumferential) positions on an upstanding spray arm proximate the periphery of the rotating table to provide lateral sprays of hot caustic solution in numerous different directions at the casting. Other fixed spray means can be disposed on respective upper and lower spray arms proximate the top and bottom of the rotatable table so as to direct hot caustic sprays downwardly and upwardly at the castings moving therebetween, while the peripherally spaced apart spray means direct hot caustic sprays laterally at the castings.

In practicing the invention to remove remnant ceramic investment shell mold material (e.g. alumina, silica, zircon, zirconia or yttira base ceramic) from nickel base superalloy equiaxed, DS (directionally solidified), and SC (single crystal) turbine blade or vane investment castings, the hot caustic solution can comprise 30–55 weight % KOH at elevated temperature from about 200–350 degrees F. and discharged at a spray pressure of about at least about 100–400 psi from the spray nozzles. The ceramic shell mold material can be removed from the exterior of castings in the one step operation in a relatively short time, such as about 1 to 2 hours, depending upon the number and configuration of the castings. Importantly, DS and SC castings can be cleaned of remanant shell mold material in accordance with the invention while avoiding unwanted and deleterious localized recrystallized regions in the casting microstructure. These recrystallized regions can be cause for rejection of the castings.

DETAILED DESCRIPTION OF THE INVENTION

Figure 1:
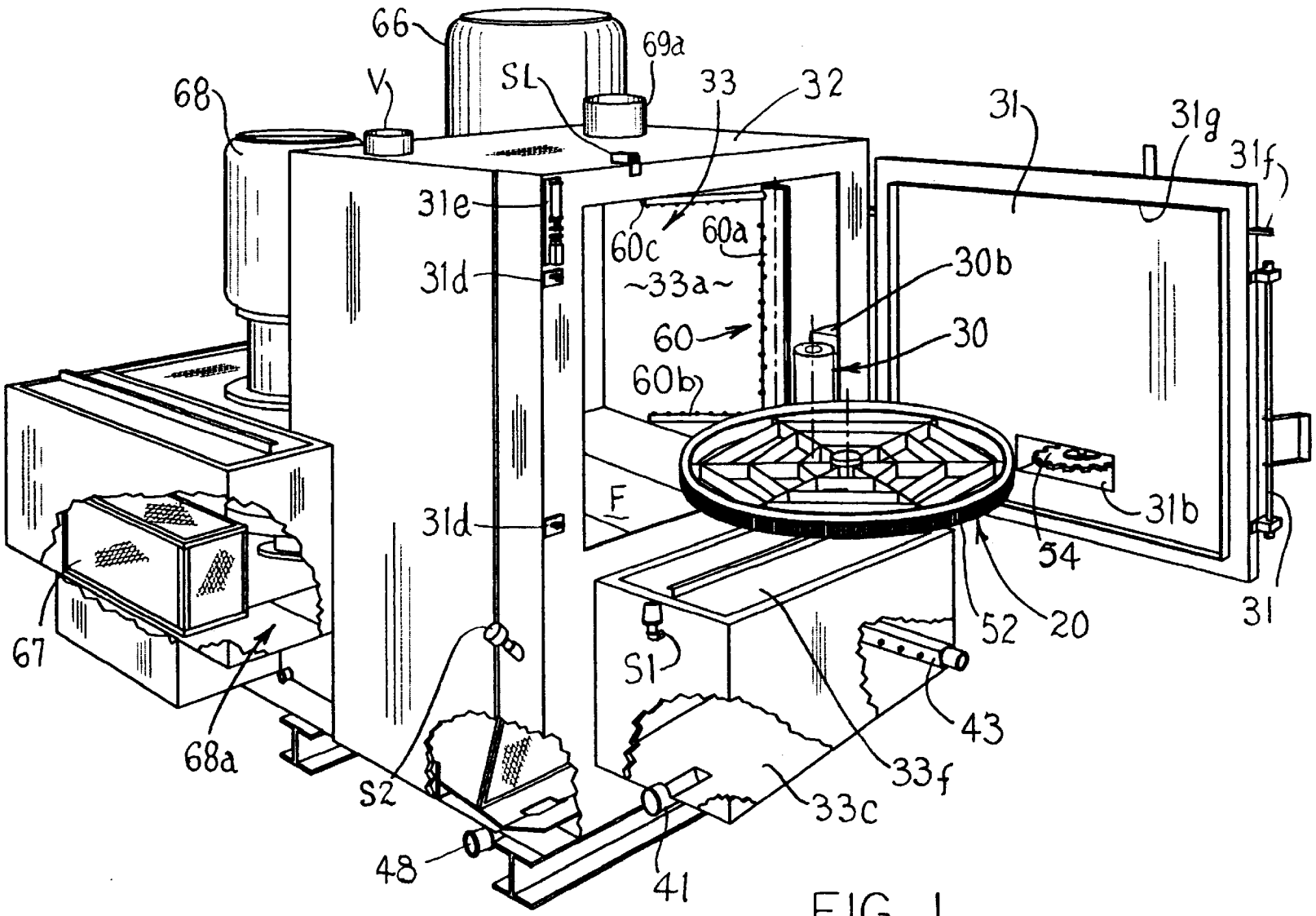
FIG. 1 is a perspective view of one embodiment of the apparatus of the invention for removing a ceramic shell mold from exterior surfaces of castings disposed on a lower rotatable table and optional shelf (not shown in FIG. 1 but shown in FIG. 3) with an access door of the apparatus in the open position.

One embodiment of the present invention for removing remnant ceramic shell mold material from a plurality of superalloy investment castings is illustrated in FIGS. 1–11. In particular, referring to FIG. 3, a plurality of turbine vane cluster investment castings 10 are shown fixtured on an upper, stackable table shelf 22 and a plurality of turbine blade investment castings 12 are shown fixtured on a lower rotated table 20. Multiple turbine blade castings 12 are interconnected by a common solidified pour cup C from the casting operation to provide several different groups of turbine blade castings. The castings 10 and 12 have remnant or residual ceramic mold material as represented by the reference numeral 25 following a conventional knock-out operation. In the knock-out operation, the casting in the investment shell mold (not shown) is struck with a pneumatic hammer or ball peen hammer to knock off or dislodge loose shell mold material from the castings 10, 12 in the molds. The knock-out operation typically leaves ceramic shell mold material residing on minor exterior regions of the castings 10, 12 with the residual ceramic material having widely varying thickness from a thin layers at some exterior regions of the casting to a relatively thick layer (e.g. 2 inch thick) at other regions at other exterior regions of the casting depending upon casting configuration. This remnant or residual ceramic mold material must be removed before further processing of the castings 10, 12 is undertaken as is well known.

Figure 3:
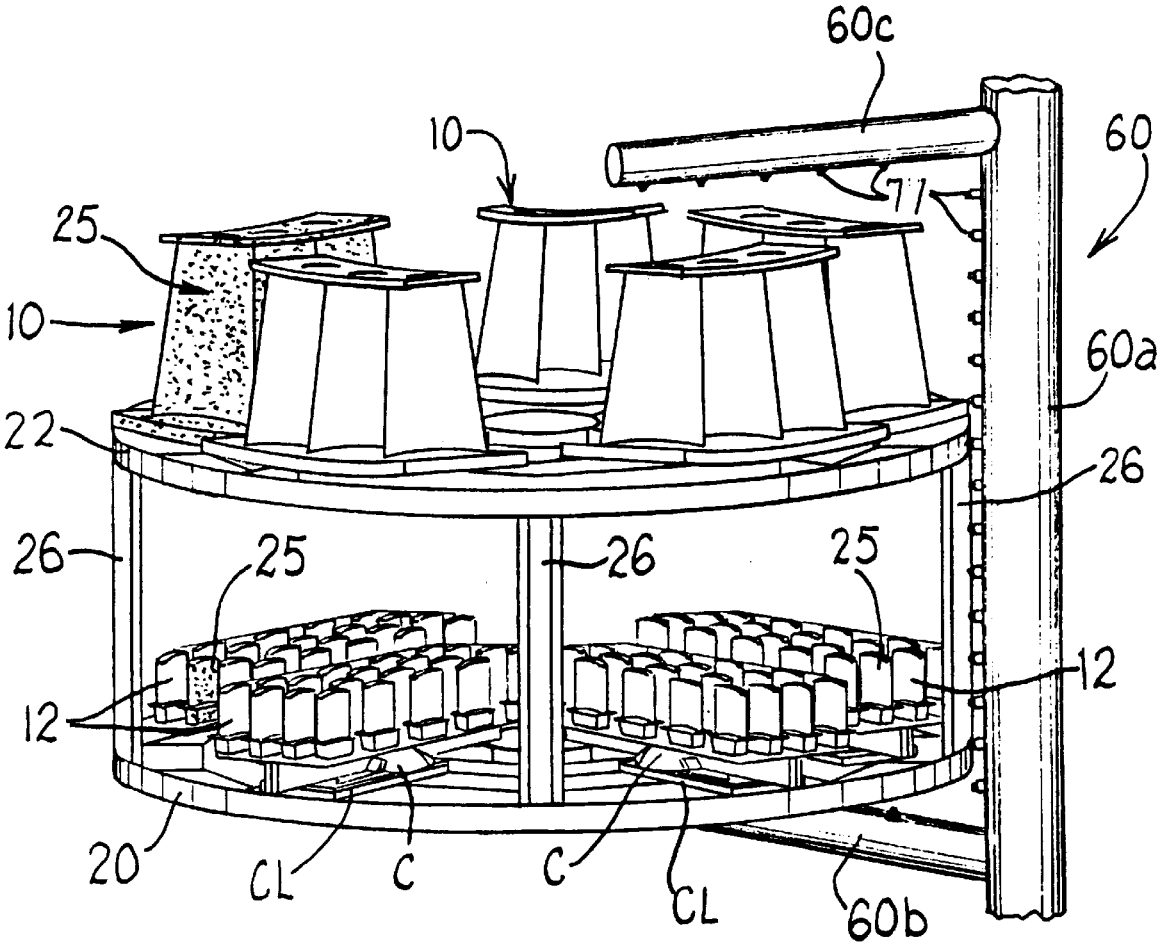
FIG. 3 is a perspective view of the rotatable table with an upper shelf thereon and the fixed spray arm assembly shown schematically in an operable position relative to the table and shelf for removing ceramic shell mold material from the castings, the driven chain not being shown for convenience.
Figure 7:
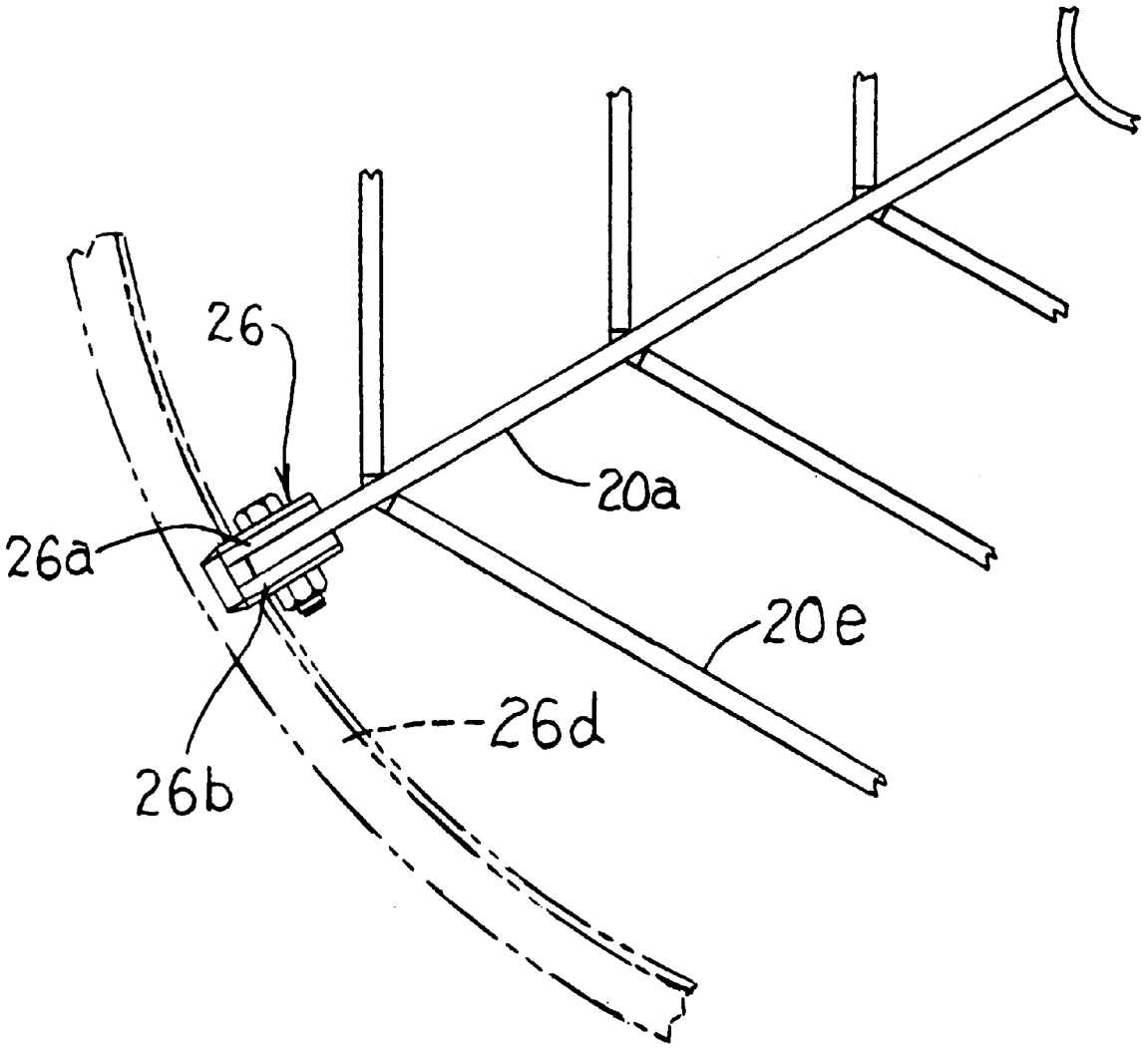
FIG. 7 is a partial plan view of one of the shelf support post members.
Figure 8:
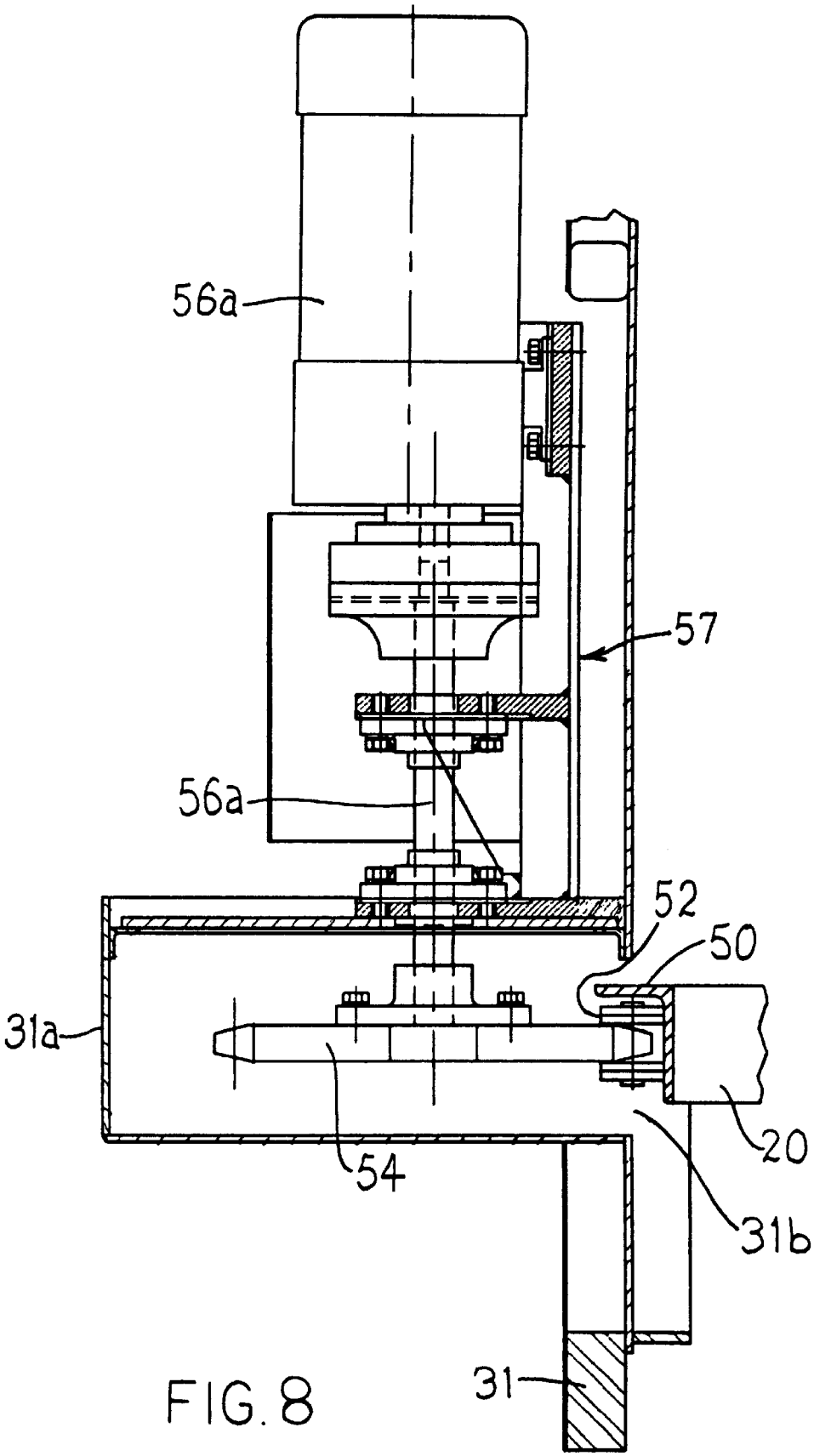
FIG. 8 is a view illustrating the table drive mechanisim for rotating the table relative to the fixed spray arm assembly.

The lower table 20 and upper table shelf 22 are similarly constructed. For example, the lower table 20 comprise radial rib support members 20*a* extending from a central hub 20*b* to an outer circumferential ring 20*d* and cross members 20*e* welded between the radial ribs to form an open, spider-web type of configuration. The upper shelf 22 is of like construction and is supported on the lower table 20 by a plurality of upstanding support posts 26 spaced circumferentially apart (e.g. 3 posts spaced 120 degrees apart). The support posts 26 each comprise a pair of spaced apart post members 26*a*, 26*b* (FIG. 7) bolted together to define fork-like ends. Each opposite fork-like end of the support posts 26 is fastened to a respective radial rib support member 20*a* of the lower table 20 and radial rib support rib member of upper shelf 22 by stainless steel shaft extending through a lateral hole in each rib member and held in place by end nuts as shown for the radial rib support members 20*a* of the table 20 as shown in FIG. 7. Although one upper table shelf 22 is shown in FIG. 3, the invention is not so limited and additional table shelfs can be positioned one above another and supported by similar support posts 26 to provide a multi-shelf or tier assembly for receiving additional castings to be cleaned.

The turbine blade investment castings 12 are fixtured on the lower rotatable table 20 by a suitable table clamps CL that engages the common solidified pour cup C from the casting operation wherein the pour cup is connected to the castings by solidified runners as is known in the casting art. The turbine vane cluster investment castings 10 are fixtured on the upper shelf 22 by suitable table clamps or fixtures (not shown).

The turbine vane cluster castings 10 and individual turbine castings 12 can comprise equiaxed, columnar, or single crystal nickel base or cobalt base superalloy castings made by well known conventional investment or other casting processes. Although FIG. 3 illustrates turbine blade cluster castings 10 and individual turbine blade castings 12, this is only for purposes of illustration and not limitation. The invention is not limited to any particular casting technique or to any particular casting shape, casting metal, alloy or other material, or casting microstructure and can be practiced to remove a core from a wide variety of casting shapes, microstructures, and compositions produced by different casting processes.

The ceramic investment shell mold material 25 residing on the castings 10, 12 comprises a ceramic material selected in dependence on the metal, alloy or other material to be cast thereabout in the casting mold. For nickel base superalloys used in the manufacture of cast turbine blades and vanes as well as vane segments or clusters, the ceramic mold material 25 residing on the castings 10, 12 after the knock-out operation can comprise alumina based ceramic, silica based ceramic, or zirconia based ceramic. The invention, however, is not limited to removal of any particular ceramic mold material 25 and can be practiced to remove other ceramic material that is remnant or residing on part or all of exterior surfaces of the castings and is dissolvable in a suitable ceramic dissolving fluid, such as, for example only, a hot aqueous caustic solution.

Referring to FIGS. 1–11, the rotatable lower table 20 is shown mounted on a pivot assembly 30 attached to a wall of the cleaning cabinet 32. In particular, referring to FIGS. 4–6, the pivot assembly 30 includes a fixed pivot post 30*a* disposed between upper and lower support mounts 30*b* fastened to the cleaning cabinet wall. A tubular support sleeve 30*c* is rotatably disposed on the pivot post 30*a* by upper and lower thrust washer, O-ring gland, and bearing sleeve assemblies (not shown) between the sleeve 30*c* and post 30*a*. A horizontally extending table swing or pivot arm 34 is connected (e.g. welded) to the support sleeve 30*c* for swinging or pivoting movement in a horizontal plane. A pair of relatively adjustable wedges disposed on the adjacent wall of the cleaning cabinet 32 form an adjustable stop 29 to limit the extent of travel or swing of the table 20.

The swinging pivot arm 34 includes a support plate 34*a* welded proximate an end thereof and a vertical spindle or shaft 36 welded to the plate 34*a*. The hub 20*b* of the lower table 20 is disposed on the spindle or shaft 36 by upper and lower thrust washers 35 and bearing sleeve 37 therebetween so that the table 20 is rotatable relative to the arm 34.

The table 20 includes an annular angle member 50 tack welded to the outer circumferential ring 20*d* of the table 20. A driven chain 52 is affixed (e.g. welded) to the angle member 50.

The driven chain 52 is in mesh with a rotatable drive sprocket 54 on a drive shaft 56*a* of an electrical motor 56 mounted on the outside of the access door 31 by a frame 57 fastened (e.g. welded) to a door enclosure 31*a* in which the sprocket 54 is disposed, FIG. 7. The door enclosure 31*a* includes an opening 31*b* through which a portion of the sprocket 56 extends into meshing engagement with the table driven chain 52 when the table 20 is disposed in the cabinet and the door 31 is closed. Energization of the motor 56 drives the sprocket 54 and thus rotates the table 20 and shelf 22 on which the castings 10, 12 are disposed.

Figure 2:
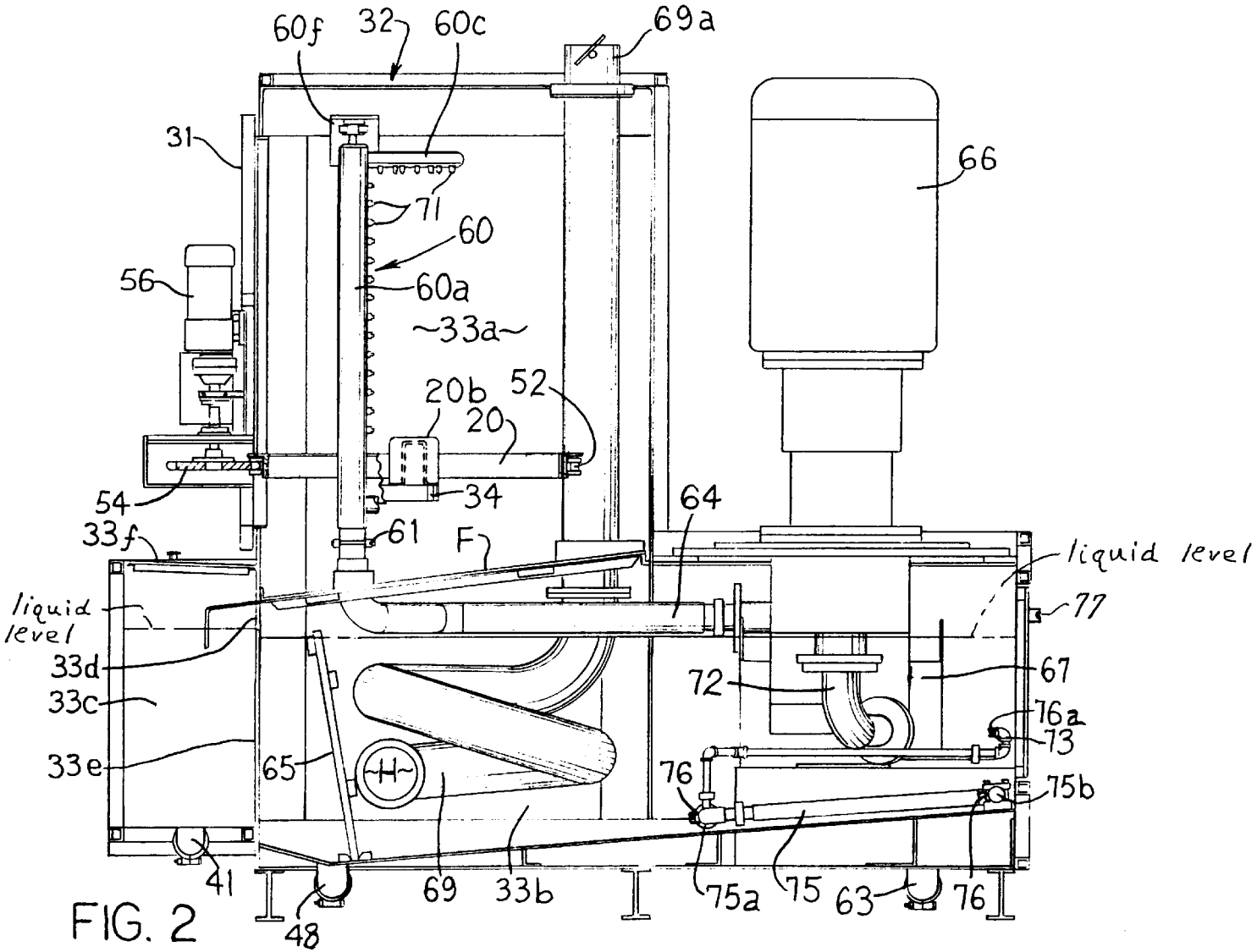
FIG. 2 is an elevational view of the cleaning cabinet with sidewalls removed to illustrate components disposed inside the cabinet.

Referring to FIGS. 1 and 2, the cleaning cabinet 32 defines a cleaning chamber 33 therein openable/closeable by the door 31. A limit switch SL is used to detect door closure in order to proceed with the cleaning operation. The cabinet 32 includes an inner walls and outer walls 32*a*, 32*b* between which insulation 32*c* is disposed as shown, for example, in FIG. 4 for purposes of illustration. The door 31 is pivotable about lower and upper pivots (only upper pivot 31*c* shown in FIGS. 4 and 5 with the lower pivot being similar). The cleaning chamber 33 includes a cleaning region 33*a* and a sump region 33*b* underlying the cleaning region 33*a* and separated therefrom by a solid floor F of stainless steel that is slanted or angled toward a sludge settling region or tank 33*c* at the front of the cabinet 32 to direct sprayed caustic solution after contacting the castings and all mold material removed from the castings and other matter to the sludge settling region or tank 33*c*. The sludge settling region and sump region are communicated at an opening 33*d* defined in the upstanding wall 33*e* to provide liquid behind wall 33*e*. The normal caustic solution liquid level heights or lines in the regions 33*b*, 33*c* are shown in FIG. 2. The sludge region or tank includes a removable lid 33*f*.

A high liquid sensor S1 is provided proximate the sludge settling region or tank 33*c* to sense the level of liquid. A liquid temperature sensor S2 is provided in the sump region 33*b* as shown in FIG. 1 to sense temperature of the caustic solution therein. The floor F is provided to prevent objects from being dropped into the sump region 33*b*. An ambient vent V with a blower (not shown) is disposed on the top of the cabinet 32 above the cleaning region 33*a* to provide a negative pressure therein relative to ambient to prevent steam from escaping the cabinet 32.

Sludge in the settling region or tank 33*c* can be removed via a sludge tank drain 41 and a sludge tank floor wash manifold 43 in the region or tank 33*c*. The manifold 43 includes multiple nozzles that discharge water or caustic solution toward the drain 41 to flush and clean sludge from the region or tank 33*c* for discharge out of the drain 41.

A fixed, tubular spray arm assembly 60 is disposed in the cleaning region 33*a*. The spray arm assembly 60 receives hot caustic solution through a conduit 64 extending from a high pressure pump 66. The high pressure pump 66 receives hot caustic solution from a relatively low pressure pump 68.

In particular, the relatively low pressure pump 68 (e.g. a 25 horsepower electric pump) and the relatively high pressure pump 66 (e.g. a 150 horsepower electric pump) are positioned in tandem manner such that the low pressure pump 66 draws hot caustic solution directly from the sump region 33*b*, or optionally through a conduit extending from the low pressure pump into the sump region 33*b*.

The sump region 33*b* includes a series of settling areas and stainless steel filters to keep large pieces of shell mold material (e.g. shell mold material greater than 0.016 inch diameter) from entering the low pressure pump 68 as hot caustic solution is drawn from the sump region 33*b*. To this end, a filter screen 65 is disposed in the sump region 33*b* between the sludge settling region or tank 33*c* to form a more rearward portion of the sump region 33*b* where the caustic solution is pumped from the sump region. As shown in FIG. 1, a pump intake filter 67 is disposed at the rearward portion of the sump region 33*b* where caustic solution enters the low pressure pump inlet region 68*a*. The sump region 33*b* and intake region 68*a* include respective drains 48 and 63.

The low pressure pump 68 supplies the hot caustic solution to the second high pressure pump 66 via conduit 72 (FIG. 2) that, in turn, supplies pressurized hot caustic solution to the spray arm assembly supply conduit 64 in the cleaning region 33*a*. A closed-loop, recirculating hot caustic solution system is thereby provided. Impellers of the pumps are coated with a hard nickel coating to reduce wear resulting from suspended ceramic shell mold material in the hot caustic solution.

The sump region 33*b* receives hot caustic solution discharged from the spray arm assembly 60 against the castings 10, 12 by overflow from the sludge settling region or tank 33*c* via the opening 33*d*. Proximate the bottom of the sump region 33*b* is disposed a caustic solution heating device, such as a serpentine heat exchanger 69, to heat the caustic solution to the desired temperature for removal of the ceramic shell material from the castings 10, 12. The heating device comprises a conventional gas fired burner and blower assembly (not shown) disposed externally of the cabinet 32 to provide hot gas flow to the serpentine heat exchanger 69 submerged in the caustic solution residing within the sump region 33*b*. The heat exchanger 69 exhausts via conduit 69*a* through the top or roof of the cabinet 32.

The level of hot caustic solution in the sump region 33*b* is determined by a float sensor or electric probe (not shown). Hot make-up water at 180 degrees F. is admitted to the sump region 33*b* at inlet pipe 77 to maintain the liquid level. Caustic is added instead of water when the concentration is low. All water lines entering the cabinet 32 and providing water during operation enter above the level of the hot caustic solution to prevent over-heating of the water. To improve control of the concentration of the caustic solution during the cleaning operation, it is desirable to maintain the temperature of the cleaning solution below its boiling temperature (minimizing water additions).

Sump rinsing manifolds 73 and 75 are provided in the sump region 33*b*. The manifold 73 includes a single nozzle 76*a* oriented to discharge hot water or caustic to rinse the sides of the sump region and the manifold 75 includes a plurality of similar nozzles 76 spaced apart along forward and rear lengths 75*a*, 75*b* thereof to rinse the bottom floor of the sump region 33*b* when the cleaning cabinet 32 is shut down for cleaning.

The spray arm assembly 60 is positioned in the cleaning region 33*a* at a front corner of the cabinet 32 between an upper arm mounting block 60*f* and the upper section of fixed supply conduit 64. The uppermost knob 61 of the spray arm assembly is received in the mounting block and secured therein by a fastener, such as a bolt. The spray arm assembly 60 is in fluid communication to the fixed supply conduit 64 that receives pressurized heated caustic solution from the high pressure pump 66. In particular, the spray arm assembly 60 includes a lower section that is fastened (e.g. clamped) to an upper section of the supply conduit 64 by a suitable clamp 61 with suitable gaskets disposed between the clamped sections. The supply conduit 64 is supported on the floor F of the cleaning region 33*a*.

The spray arm assembly 60 includes an upstanding tubular spray arm 60*a* that is fluid communicated to the supply conduit 64 from the high pressure pump 66 to receive hot caustic solution under pressure and lower and upper horizontal, offset tubular spray arms 60*b*, 60*c* communicated to the upstanding spray arm 60*a* to receive the hot caustic solution therefrom. Each of the spray arms 60*a*, 60*b*, 60*c* includes a plurality of stainless steel or hardened stainless steel spray nozzles 71 (spray means) threaded into apertures machined in the spray arms. As shown best in FIG. 4, the upper spray arm 60*c* extends generally radially over the table 20 to the center thereof. The lower spray arm 60*b* extends below the table 20 near or proximate center of the table 20. The upstanding spray arm 60*a* is disposed proximate the circumference of the table chain 52 to provide a spray pattern over the table as illustrated by the spray cones shown.

Figure 4:
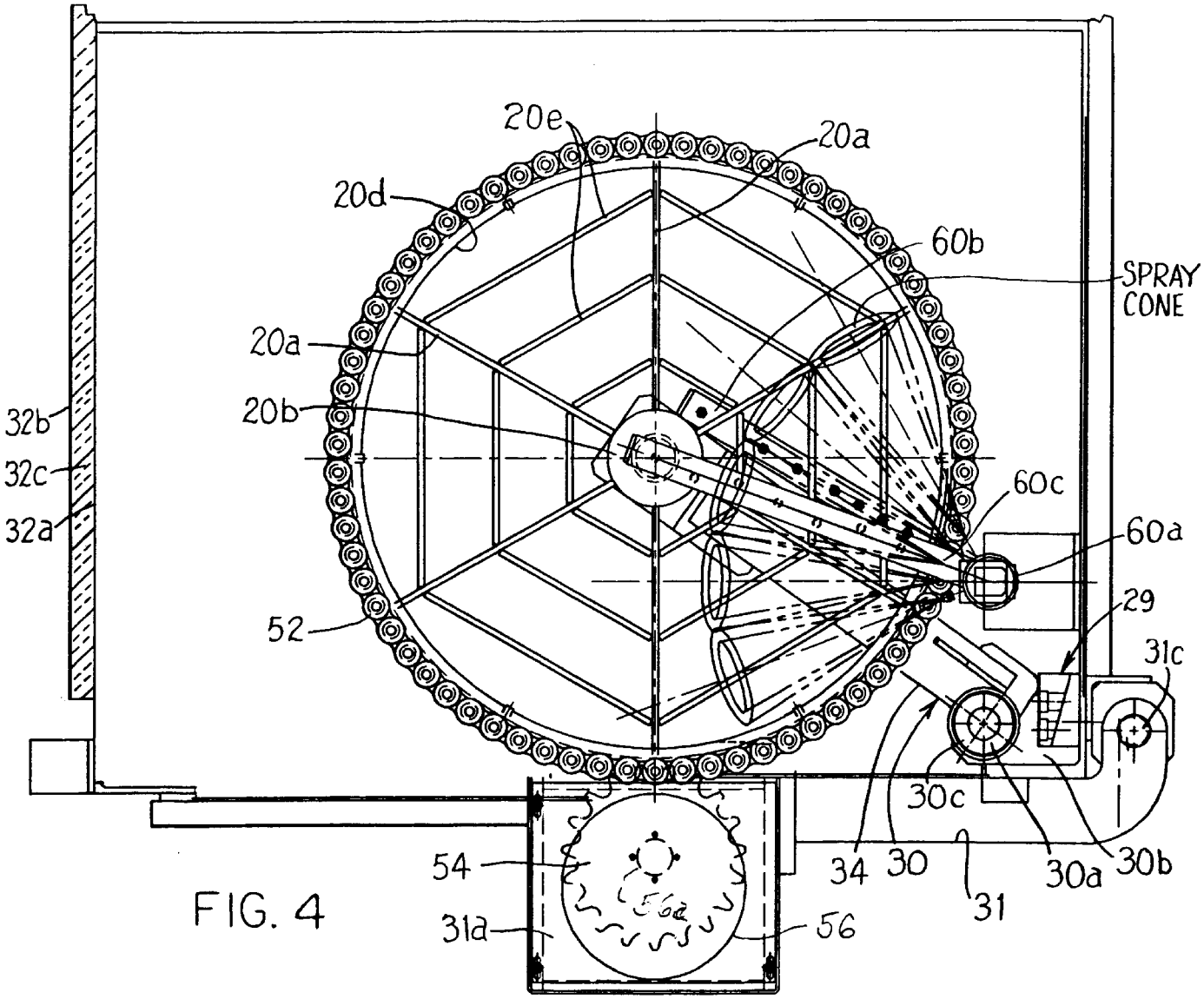
FIG. 4 is a plan view of the rotatable table sans shelf and sans the upper surface of angle member and of fixed spray arm assembly in operable position relative to one another in the cabinet with spray cones illustrated.
Figure 5:
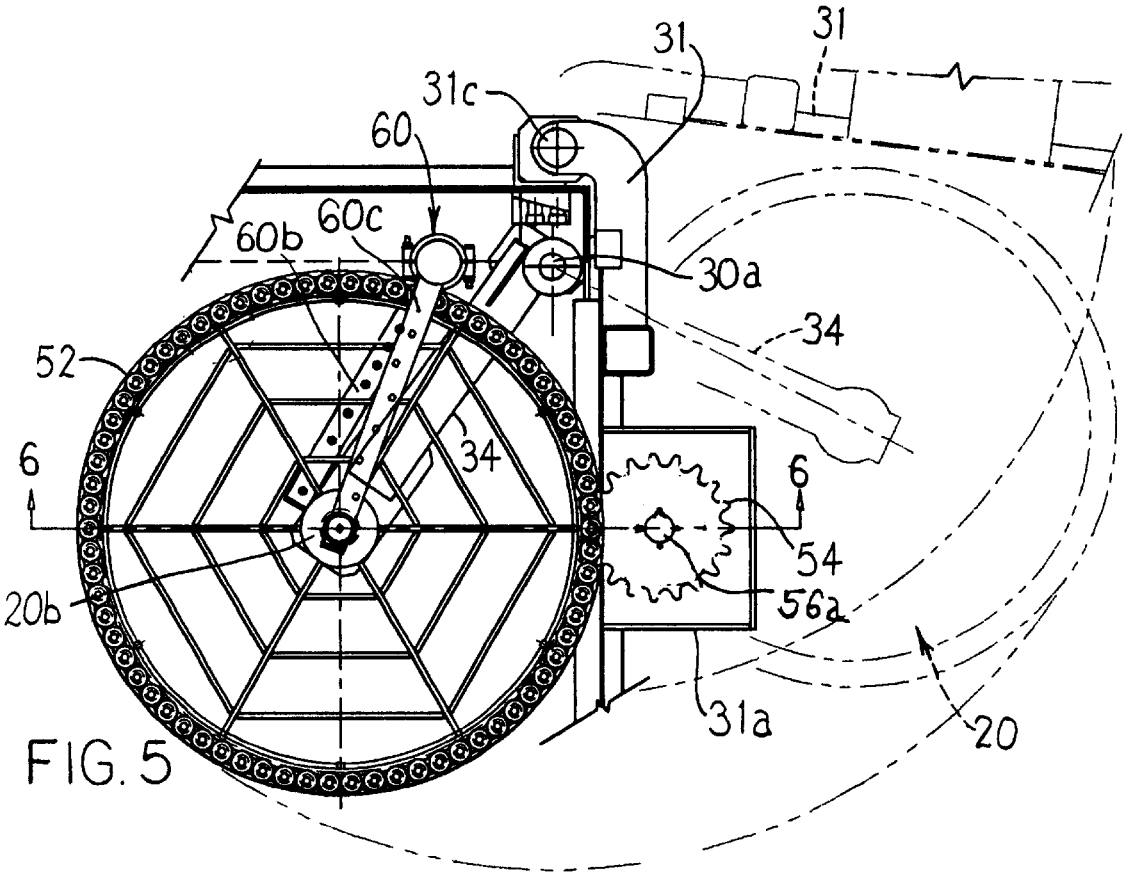
FIG. 5 is a partial plan view of the rotatable table sans shelf and the spray arm assembly with independent table pivot support, the table being shown in solid lines positioned in the cabinet and in hidden lines positioned outside the cabinet.
Figure 6:
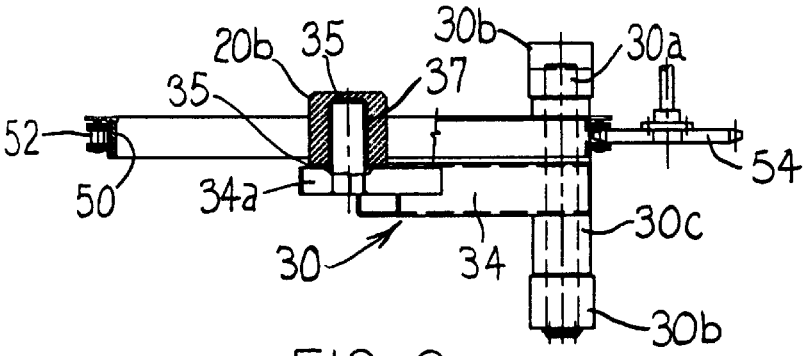
FIG. 6 is a view of the spray arm assembly looking in the direction of arrows 6—6 in FIG. 5 showing the table pivot support.

The spray nozzles 71 receive hot caustic solution under pressure from the spray arms 60*a*, 60*b*, 60*c* and discharge the hot caustic solution at the castings 10, 12 moving in the clockwise or counterclockwise direction in FIG. 4 past the stationary spray arms. The spray nozzles 71 are spaced in the range of about 2.25 to 4.50 inches from the castings 10, 12 on table 20 and table shelf 22 depending on location of the particular spray nozzle on spray arm assembly 60.

Figure 10:
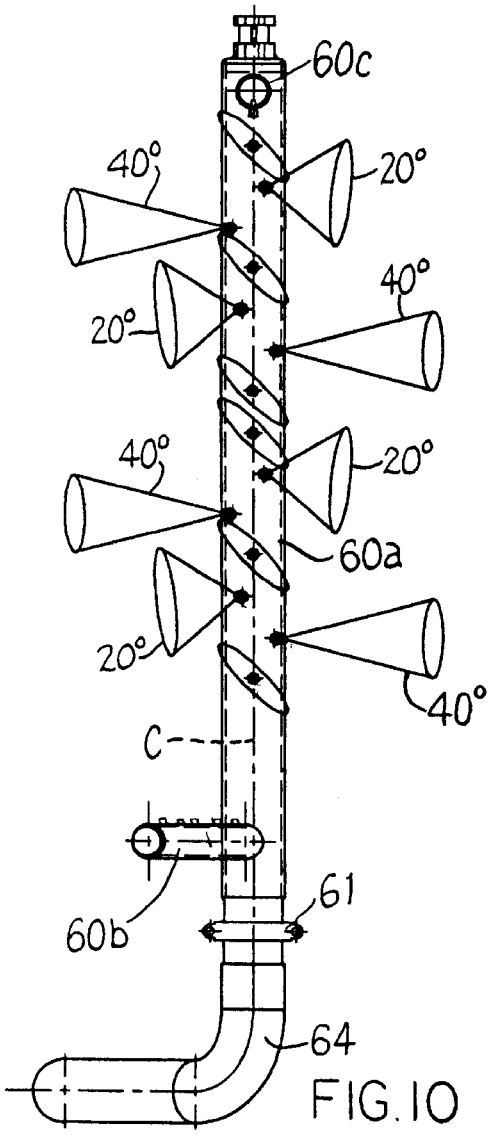
FIG. 10 is an elevational view of the spray arm assembly in a direction parallel to the upper spray arm with the nozzle spray cones illustrated.
Figure 9:
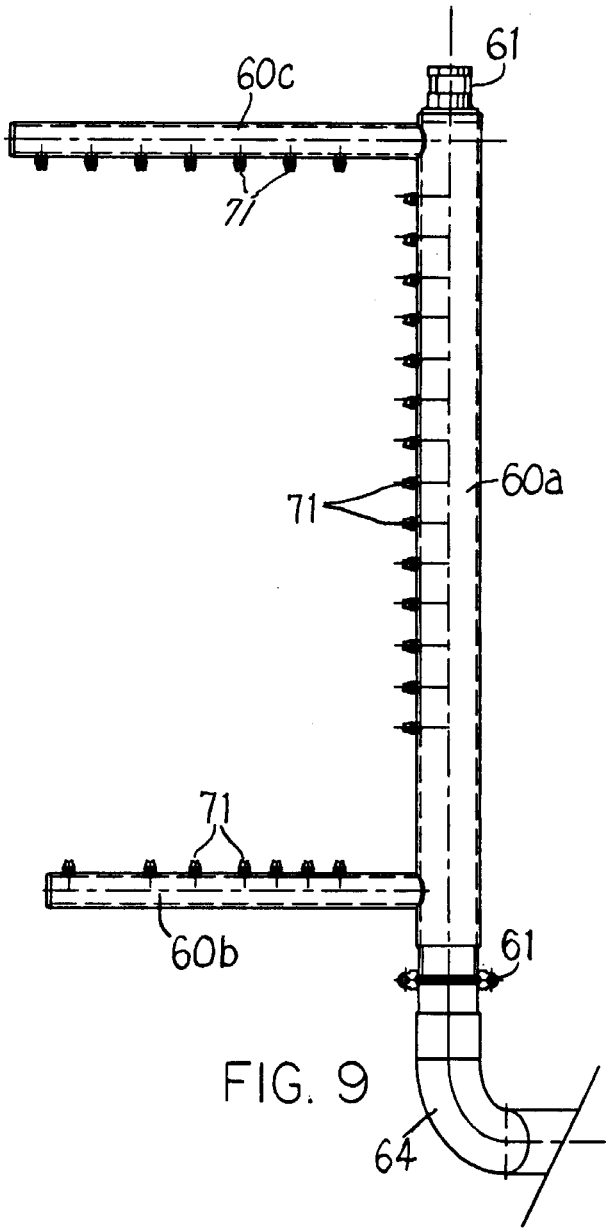
FIG. 9 is an elevational view of the spray arm assembly.

The spray nozzles 71 on the spray arm 60*a* are oriented at different angles relative to the longitudinal axis or centerline C of the arm (i.e. at different circumferential positions on the cylindrical spray arm 60*a*) so as to discharge hot caustic solution in different directions at the castings 10, 12 as illustrated best in FIGS. 4 and 10 where the spray cones (spray discharge) of the nozzles 71 are illustrated. For example, in FIG. 10, some spray nozzles 71 (e.g. 6 nozzles) are shown disposed on the axis C. Other spray nozzles 71 (e.g. 4 nozzles) are disposed 20 degrees right or left of the axis C, while still other spray nozzles 71 (e.g. 4 nozzles) are disposed 40 degrees right or left of the axis C. The axial spacing (nozzle centerline to centerline) of the spray nozzles 71 on arm 60*a* is 2.25 inches. The spray nozzles 71 on upper spray arm 60*c* are oriented downwardly in like manner to discharge downward spray cones of hot caustic solution. Some of the spray nozzles 71 (e.g. 3 nozzles) on arm 60*c* are disposed on the arm longitudinal axis or centerline while other spray nozzles (e.g. 4 nozzles) are offset from the axis C in alternating manner as shown best in FIG. 11 and spaced axially 2.75 inches apart (nozzle centerline to centerline). The spray nozzles 71 on the lower spray arm 60*b* are oriented upwardly in like manner and are disposed on the longitudinal axis or centerline of the arm 60*b* to discharge upward spray cones of hot caustic solution. The axial spacing (centerline to centerline) of the spray nozzles 71 on arm 60*b* varies. The first through fourth nozzles counting from the right in FIG. 9 are spaced 1.75 inches apart. The axial spacing between the fourth and fifth nozzles 71 counting from the right in FIG. 9 is 2.75 inches. The fifth and sixth nozzles 71 are axially spaced apart 2.50 inches, while the sixth and seventh nozzles 71 are axially spaced apart 4.5 inches.

Figure 11:
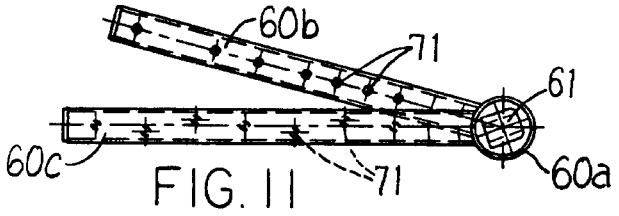
FIG. 11 is a plan view of the spray arm assembly.

The lower and upper spray arms 60*b* and 60*c* are offset angularly relative to one another by 15 degrees as best illustrated in FIG. 11. The numerous, different directions of spray discharge of the nozzles 71 provided by the particular nozzle arrangement shown in FIGS. 9–11 provides a plurality of sprays at exterior surfaces of the castings 10, 12 effective to remove the cermaic shell mold material 25 from all exterior surface areas of the castings 10, 12. The invention is not limited to the particular spray discharge patterns shown and can be practiced using other patterns that are effective to remove the cermaic shell mold material 25 from all exterior surface areas of the castings 10, 12. The spray pattern and spray orientation can be chosen to cover the entire area of the table 20 in front of spray arm assembly and provide spray at the castings as they are moved into the spray pattern and at the castings as they move away from the spray pattern. This allows for direct spray along multiple sides of the castings as well as top and bottom of the castings. The particular pattern of spray discharges can be readily selected to this end.

The spray nozzles 71 are sized to provide a selected fluid flow rate (e.g. 19 gallons per minute per nozzle) of the hot caustic solution at the castings. The particular spray nozzles 71 shown are available under designation Washjet spray nozzles (¼ MEG-2560, hardened stainless, ¼ inch NPT) available from Spraying Systems Co., North Ave., Wheaton, Ill. 60188.

The door 31 and cabinet 32 as well as other numerous components in the cabinet exposed to the hot caustic solution can be made of Type 304L stainless steel or other suitable material resistant to the corrosive effects of the solution.

In accordance with a method embodiment of the invention, the castings 10, 12 having residual ceramic mold material thereon are clamped on the table 20 and table shelf 22 as described hereabove when the door 30 is opened and the table 20 and shelf 22 are swung on pivot assembly 30 outside of the cabinet 32 for easy access for loading of castings. Then, the loaded table 20 and shelf 22 are swung on pivot assembly 30 and the door 30 is closed and latched by latchs 31*c*/latch plates 31*d* and door locking clamp 31*e*/lock plate 31*f* to prevent the door from being opened during cleaning of the castings 10, 12 to remove the remnant ceramic mold material. The door 31 includes a seal 31*g* to seal against the cabinet 32.

As mentioned, the hot caustic solution is selected so as to be capable of dissolving the ceramic shell mold material residing on the castings 10, 12. For the ceramic shell mold material described hereabove used in the manufacture of nickel based and cobalt based superalloy castings, a suitable hot caustic solution comprising from about 30% to 55% by weight KOH or higher can be used at a temperature between about 200 and 350 degrees F. or higher and a spray pressure of at least about 100 psi and higher (depends on pump capability available) at a solution flow rate from the nozzles 71 of about 11 to 30 gallons per minute (GPM), such as for example 19 GPM per nozzle. Alternately, an aqueous caustic solution comprising about 30% to about 50% by weight NaOH and higher at the temperatures and pressures just described can be used. These hot caustic solutions are offered for purposes of illustration only, since the invention not being limited to these particular solutions and can practiced with hot caustic solutions that are capable of dissolving a particular ceramic shell mold material involved in the manufacture of particular castings.

The elevated temperature and spray pressure of the hot caustic solution sprayed from the spray means such as spray nozzles 71 (or spray orifices) is effective to dissolve and mechanically dislodge the residual ceramic shell mold material from the exterior surfaces of the castings 10, 12 until all of the casting surfaces are cleaned of the shell mold material. The number of spray nozzles 71 and their directional orientations relative to the castings, the temperature, pressure and concentration of the hot caustic solution, as well as the resident time of the castings 10, 12 in the cleaning region 33*a* where they are impacted by the nozzle sprays are selected accordingly. Higher spray pressures, higher solution temperatures, and higher solution flow rates through the nozzles 71 generally reduce the time required to clean the castings 10, 12.

For purposes of illustration rather than limitation, the invention was practiced to remove remnant alumina based ceramic shell mold material (approximately ½ to 1 inch in thickness) from all over conventional equiaxed grain investment castings (6th turbine blade for TF34 gas turbine engine) after a knock-out operation. Twelve blade castings were cleaned at a time. Hot caustic solution used was 45 weight % KOH at a temperature of 250 degrees F. and spray pressure of 400 psi and total system flow rate of 500 GPM. The nozzles 71 were positioned in an arrangement shown in FIGS. 9–11. The table 20 was rotated in the clockwise direction at a speed of 6 rpm. The time required to remove the alumina shell mold material from the castings was 1 hour.

For purposes of further illustration rather than limitation, the invention was practiced to remove remanant alumina based ceramic shell mold material (approximately ½ to 1 inch in thickness) from all over conventional SC turbine blade investment castings (1st turbine vane for CFM-56-5A gas turbine engine). Six vane castings were cleaned at a time. Hot caustic solution used was 45 weight % KOH at a temperature of 250 degrees F. and spray pressure of 400 psi and total system flow rate of 300 GPM. The nozzles 71 were positioned in the arrangement shown in FIGS. 9–11. The table 20 was rotated in the clockwise direction at a speed of 6 rpm. The time required to remove the alumina shell mold material from the castings was about 1.5 hours.

The cleaned SC castings were examined by Laue x-ray technique for possible localized recrystallized grain regions in the casting microstructure. No localized grain recrystallized regions were found in the microstructure. Thus, the impact pressure of the hot caustic solution on the castings was insufficient to generate recrystallized regions, yet sufficient to remove the adherent ceramic mold material. This is an important advantage of the invention in that DS and SC castings can be cleaned while avoiding localized recrystallized grain regions in the casting microstructure that would be cause for casting rejection.

In practicing the invention to remove residual shell mold material from DS or SC castings, the spray pressure of hot caustic solution from the spray nozzles 71 is controlled to provide an impact pressure on the castings insufficient to cause localized recrystallized grain regions in the microstructure and yet effective to remove the shell mold material.

Although the invention has been described in terms of specific embodiments thereof, it is to be understood that modifications and changes can be made therein within the scope of the invention and appended claims.

We claim:

1. A method of removing ceramic mold material from exterior surfaces of a metallic casting, comprising:

moving said casting having ceramic mold material on said exterior surfaces thereof and directing a plurality of sprays of hot caustic solution discharged under pressure to provide spray paths with different directional orientations, said casting being moved in said spray paths to remove said ceramic mold material from said exterior surfaces of said casting.

2. The method of claim 1 wherein said casting is moved while said sprays are discharged under pressure thereat.

3. The method of claim 2 wherein said sprays are stationary while discharged at said casting.

4. The method of claim 1 wherein said hot caustic solution comprises 20–55 weight % alkali metal hydroxide in an aqueous solution at a temperature of about 200 to 350 degrees F. discharged at a spray pressure of at least 100 psi.

5. The method of claim 1 wherein said casting has a directionally solidified microstructure and said ceramic mold material is removed therefrom by controlling said pressure to avoid localized recrystallized regions in the microstructure.

6. A method of removing residual ceramic mold material from exterior surfaces of a metallic casting, comprising:

disposing said casting having said residual ceramic mold material on said exterior surfaces on a rotatable table for rotation and directing a plurality of sprays of hot caustic solution under pressure to provide spray paths with different directional orientations, said casting being rotated in said spray paths to remove said residual ceramic mold material from said exterior surfaces of said casting.

7. The method of claim 6 wherein said spray means are stationary relative to said casting.

8. The method of claim 6 including spraying hot caustic solution from spray means on respective upper and lower fixed spray arms proximate a top and bottom of the rotatable table so as to direct hot caustic sprays downwardly and upwardly at the casting.

9. The method of claim 8 including spraying said hot caustic solution laterally at said casting from spray means at different peripheral positions on an upstanding fixed spray arm.

10. The method of claim 1 wherein said hot caustic solution comprises 20–55 weight % alkali metal hydroxide in an aqueous solution at a temperature of about 200 to 350 degrees F. sprayed at a spray pressure of at least 100 psi.

11. A method of removing residual ceramic investment shell mold material from exterior surfaces of a superalloy casting having a directionally solidified microstructure, comprising:

disposing said casting having said investment shell mold material on said exterior surfaces on a rotatable table for rotation and directing a plurality of sprays of hot caustic solution under pressure to provide spray paths with different directional orientations, said casting being rotated in said paths to remove said investment shell mold material from said exterior surfaces of said casting while controlling said pressure to avoid generating localized recrystallized regions in the microstructure.

12. The method of claim 11 wherein said hot caustic solution comprises 20–55 weight % alkali metal hydroxide in an aqueous solution at a temperature of about 200 to 350 degrees F. sprayed at a spray pressure of at least 100 psi.

* * * * *